US005868256A

United States Patent [19]

Teppo

[11] Patent Number: 5,868,256

[45] Date of Patent: Feb. 9, 1999

[54] ROTARY CLAY MATERIAL REFINER

[75] Inventor: Maynard A. Teppo, Belle Fourche, S. Dak.

[73] Assignee: AMCOL International Corporation, Arlington Heights, Ill.

[21] Appl. No.: 920,989

[22] Filed: Aug. 29, 1997

[51] Int. Cl.[6] ..... B03B 5/60; B03B 5/28; B03B 5/56

[52] U.S. Cl. ..... 209/173; 209/208; 209/294; 209/299; 209/913

[58] Field of Search ..... 209/172, 172.5, 209/173, 208, 913, 294, 299

[56] References Cited

U.S. PATENT DOCUMENTS

| | | | |
|---|---|---|---|
| Re. 16,674 | 7/1927 | Chance | 209/172.5 |
| 384,861 | 6/1888 | Melkersman | 209/173 |
| 501,898 | 7/1893 | Schupp | 209/294 |
| 1,649,020 | 11/1927 | Cleland . | |
| 2,117,553 | 5/1938 | Fye | 209/452 |
| 2,119,414 | 5/1938 | Blanchard | 209/452 |
| 2,208,092 | 7/1940 | Addis | 209/452 |
| 2,450,980 | 10/1948 | Moyer | 209/452 |
| 2,608,716 | 9/1952 | Harris | 209/173 |
| 2,760,633 | 8/1956 | Davis | 209/172.5 |
| 3,014,315 | 12/1961 | Clayton | 51/164 |
| 3,392,828 | 7/1968 | Muller | 209/172 |
| 3,837,490 | 9/1974 | Driebel et al. | 209/288 |
| 3,892,563 | 7/1975 | LaPoint | 209/172.5 |
| 4,267,980 | 5/1981 | LaPoint | 209/172.5 |

FOREIGN PATENT DOCUMENTS

| | | | |
|---|---|---|---|
| 534845 | 12/1956 | Canada | 209/172.5 |
| 1222479 | 6/1987 | Canada | 209/294 |
| 866046 | 6/1941 | France | 209/193 |
| 1066339 | 1/1954 | France | 209/294 |
| 61649 | of 1892 | Germany | 209/294 |
| 191356 | 8/1957 | Germany | 209/172.5 |
| 627316 | 8/1949 | United Kingdom | 209/294 |
| 754895 | 8/1956 | United Kingdom | 209/172.5 |

*Primary Examiner*—William E. Terrell
*Assistant Examiner*—Joe Dillon, Jr.
*Attorney, Agent, or Firm*—Marshall, O'Toole, Gerstein, Murray & Borun

[57] ABSTRACT

An apparatus for refining clay material having a horizontally oriented rotating drum into which clay material and water are fed. The clay material and water form a slurry which is agitated by lifters within the drum. A series of adjustable lifters within the drum refine the slurry by lifting aggregates and rocks out of the slurry and discharging them out of the refiner. The refined slurry exits the drum through an opening in the drum. The refined slurry is then taken away from the drum for further processing.

18 Claims, 5 Drawing Sheets

ROTARY CLAY MATERIAL REFINER

FIELD OF THE INVENTION

The present invention relates to clay material refining equipment, and more particularly to clay material refining equipment where heavier, solid non-clay material (e.g., rock) is separated from a clay/water slurry.

BACKGROUND ART

Presently, the systems available to refine clay, in particular bentonite clay, are vertical batch-type systems. In these vertical batch-type systems, a fixed amount of clay and water are combined in a large clarifier to form a clay slurry. A mixing blade is inserted into the clay slurry and is rotated at a high revolution per minute (RPM). As the clay slurry is mixed, solid non-clay material such as rock is filtered out of the clay by a screen. These high RPM blades continuously hit rocks and other solid non-clay material in the clay slurry creating large impact forces which cause severe damage to the blades. This damage requires continual blade maintenance and replacement. Also, the screen used in the filtering process is susceptible to damage by the rock and is in continual need of repair or replacement as well.

Besides the maintenance problems associated with these vertical batch-type systems, these systems, since they are batch systems and not continuous, are also inefficient and slow down the overall refining process.

SUMMARY OF THE INVENTION

In accordance with one aspect of the present invention, an apparatus for refining clay material includes a drum having an inlet end and a discharge end, means for supporting the drum, means for conveying the clay material into the inlet end of the drum, means which are separate from the conveying means for introducing liquid into the inlet end of the drum to form a clay slurry, means for rotating the drum, a plurality of lifters disposed within the drum for refining the clay slurry by separating solid non-clay material from the clay slurry, a means for receiving the solid non-clay material separated by the lifters, and an opening formed in the discharge end of the drum for discharging the refined clay slurry. A further aspect of the present invention may be to position the lifters and the discharge hopper near the discharge end of the drum and to make the lifters adjustable.

In accordance with another aspect of the present invention, the refining apparatus can separate smectite clays from solid, non-clay material, such as rocks, without using a screen for separating larger solid material from smaller solid material. Separation of larger solid material from smaller solid material is accomplished by rotational mixing of solids in water and lifting the heavier solids (by virtue of the heavier solids being denser than the clay solid particles) away from the smaller solids with lifters that rotate through the clay/water slurry within the apparatus. The heavier solid materials (e.g. rocks) remain in position on the lifters due to their substantial weight, while the lighter clay solids are washed away from the lifters, as a clay/water slurry, before the heavier solids are discharged from the drum.

The means for supporting the drum of the apparatus of the present invention may be a base which may be adjustable vertically to alter the height of the inlet end of the drum, and the clay material refiner may further include a means for removing separated solid non-clay material from the discharge hopper of the apparatus of the present invention. The means for removing separated solid non-clay material and the means for conveying material into the drum may be a unitary structure. This unitary structure may be, for example, a feed screw conveyor. The clay material refiner of the present invention may also have a material feed inlet which is offset with respect to a centerline of the feed screw conveyor to prevent jamming.

Other features and advantages are inherent in the rotary clay material refiner claimed and disclosed or will become apparent to those skilled in the art from the following detailed description in conjunction with the accompanying drawings.

DESCRIPTION OF THE PREFERRED EMBODIMENT

Figure 1:
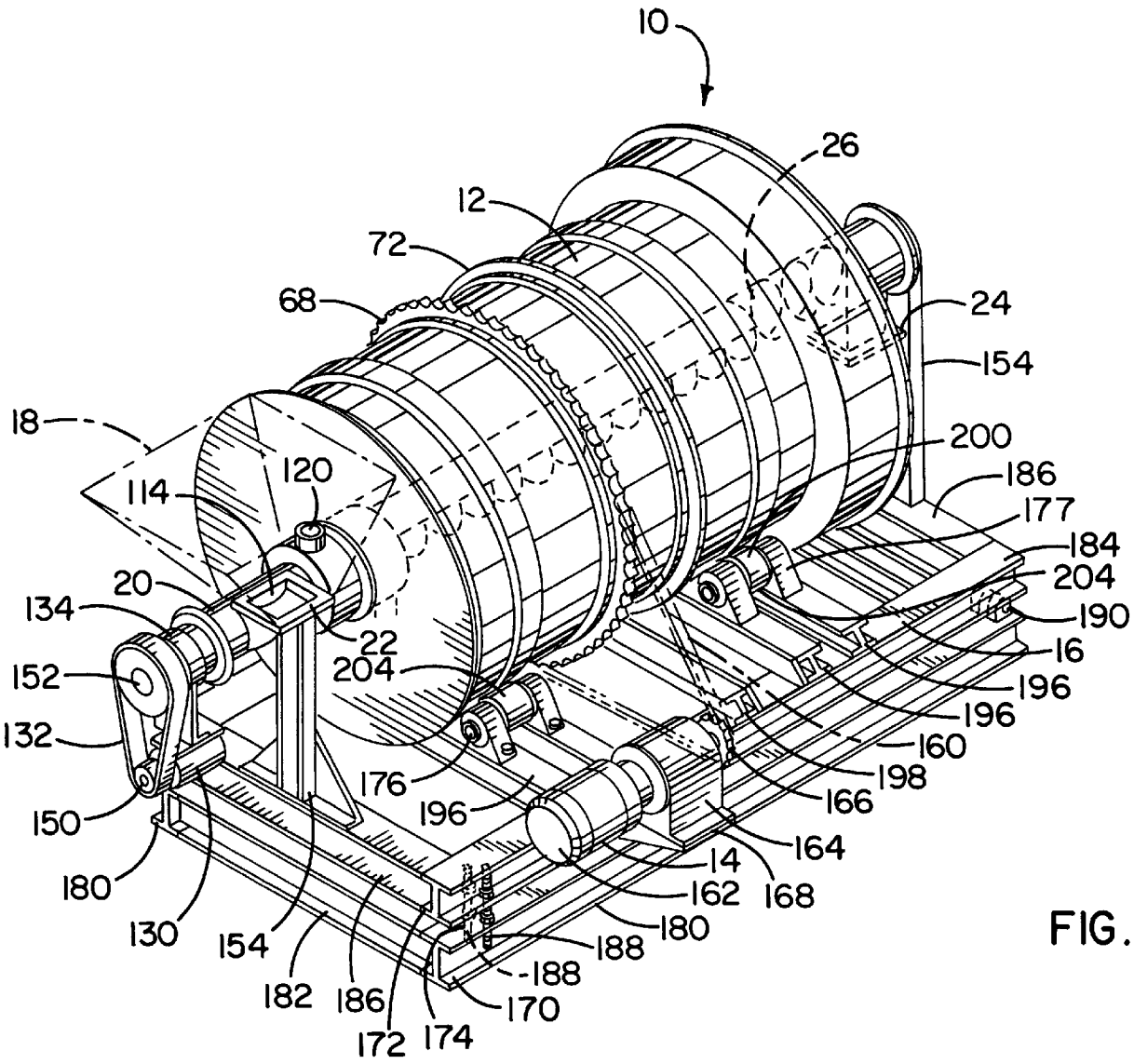
FIG. 1 is a perspective view of a rotary clay material refiner of the present invention.

Referring initially to FIG. 1, a rotary clay material refiner of the present invention, indicated generally at 10, includes a drum 12, a drum rotation assembly 14, a drum support assembly 16, a hopper 18 and a conveyor assembly 20, with the conveyor assembly 20 having a material feed inlet 22, a discharge chute 24 and a feed screw conveyor 26 (FIG. 2) which extends between the material feed inlet 22 and the discharge chute 24.

Figure 2:
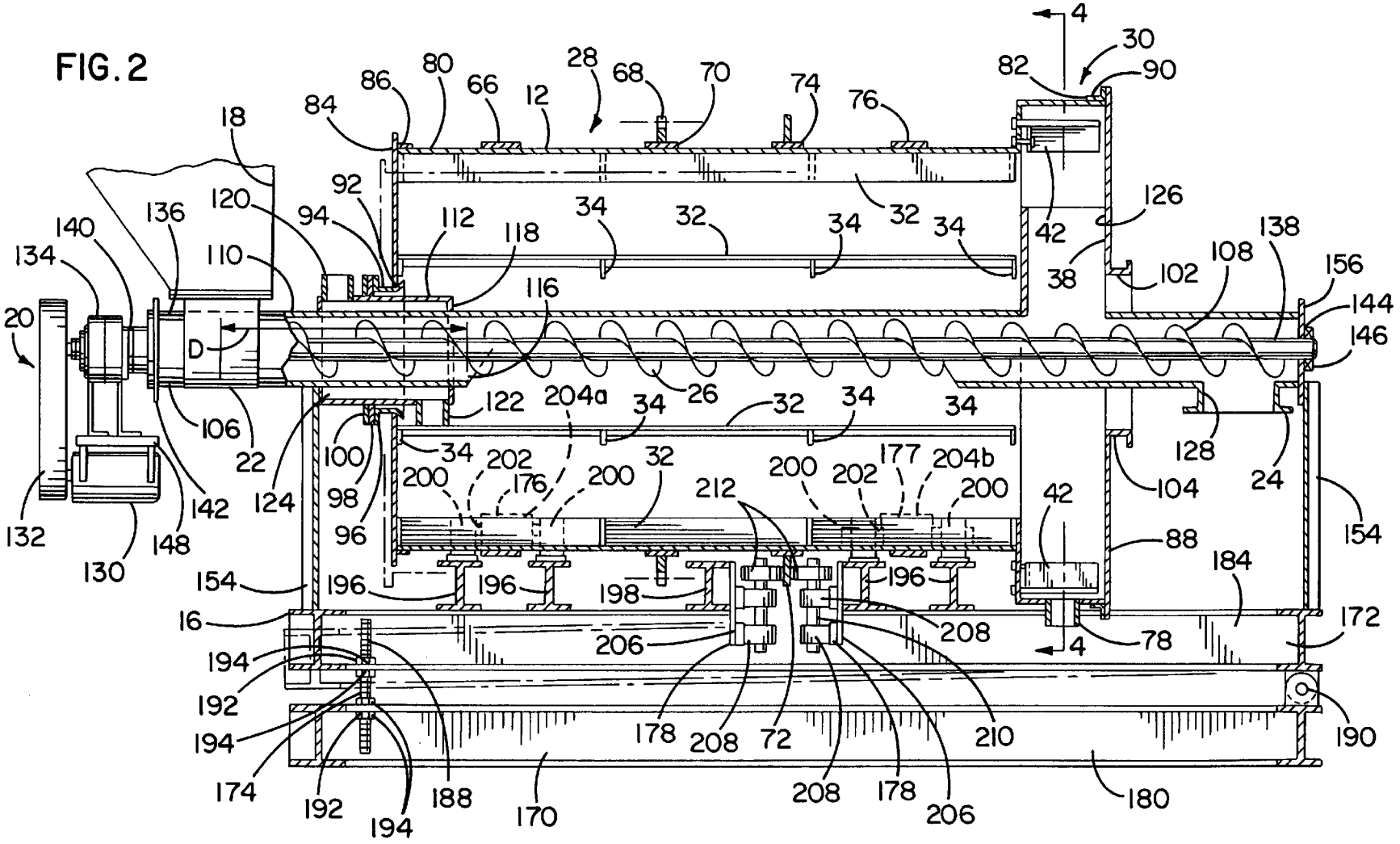
FIG. 2 is a side elevational view, partially in section, of the rotary clay material refiner and FIG. 2 further illustrates the adjustability of an inlet end of a drum of the present invention.
Figure 3:
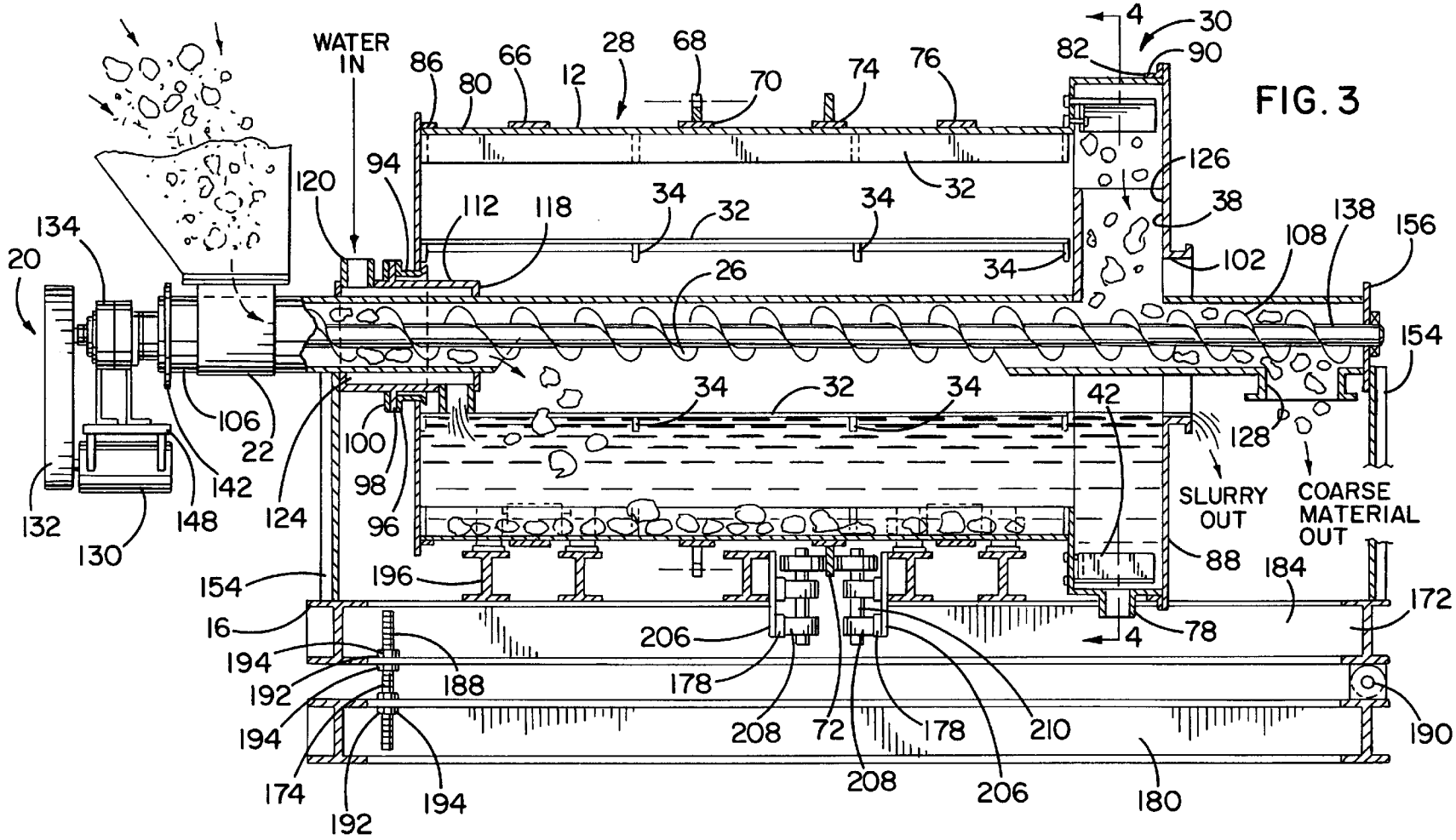
FIG.3 is a view similar to FIG. 2 showing the operation of the rotary clay material refiner.
Figure 4:
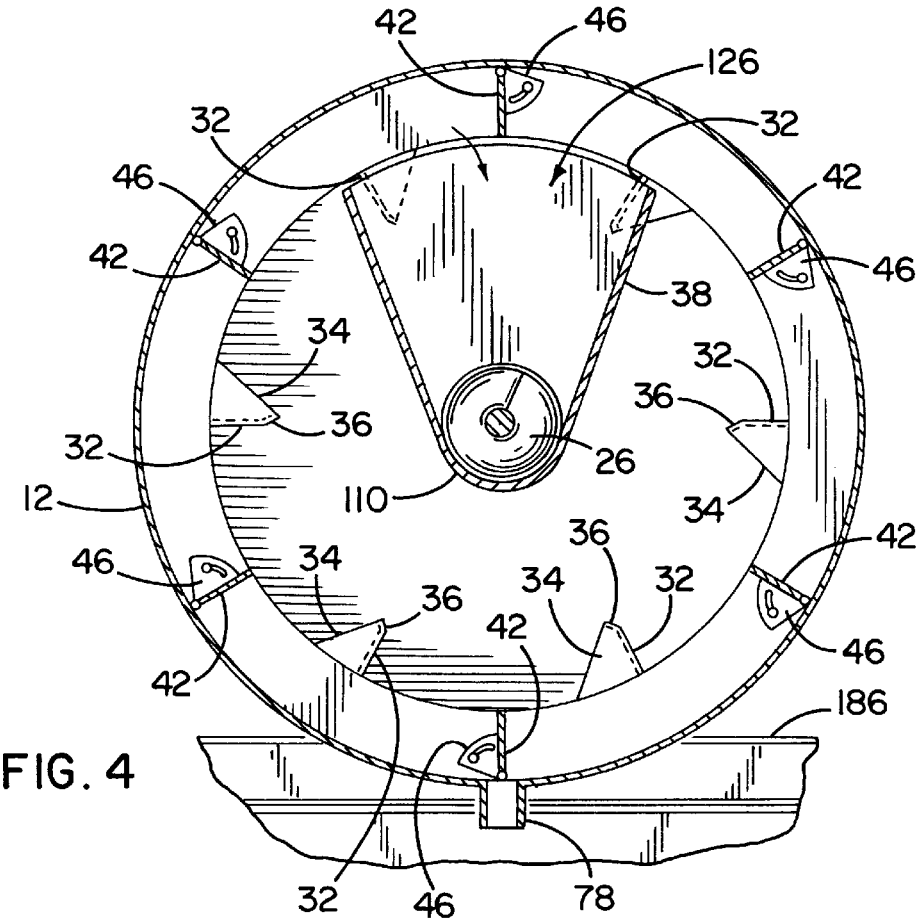
FIG. 4 is a sectional view taken along the line 4—4 in FIG. 2.
Figure 5:
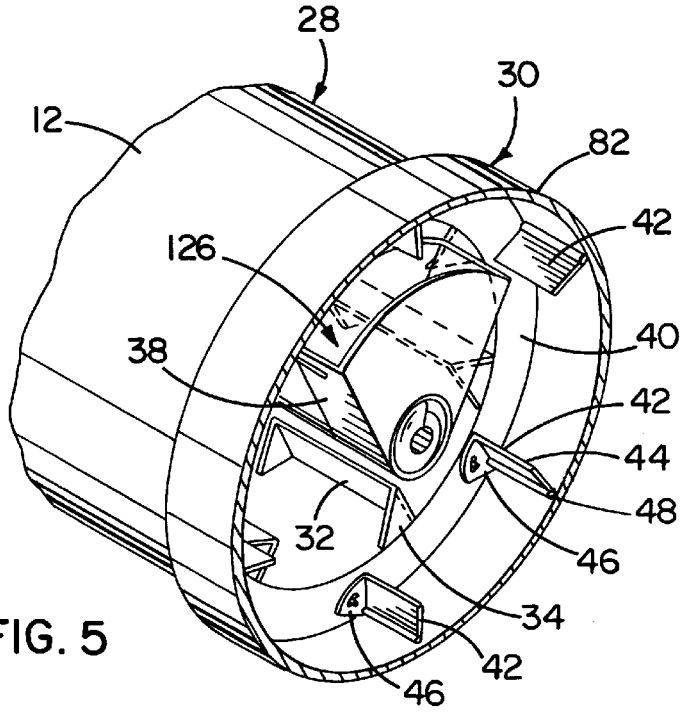
FIG. 5 is a perspective view of a discharge end of the drum of the rotary clay material refiner with an end plate removed.

Referring now to FIGS. 1–5, the drum 12 is a hollow, generally cylindrical shaped structure which lies in a generally horizontal plane. The drum 12 has a mixing section 28 and a separation and discharge section 30 (FIG. 2). As best seen in FIGS. 4 and 5, the interior surface of the mixing section 28 has a plurality of mixing lifters 32 which extend radially into the drum 12 in a direction perpendicular to the interior surface of the drum 12 and are disposed along the entire length of the mixing section 28. Each mixing lifter 32 has a series of triangular gussets 34 attached to one side surface of the mixing lifter 32 which provide support thereto with each gusset 34 forming a 45° angle with its respective mixing lifter 32. Each mixing lifter 32 also has a tip 36 (FIG. 4) which angles at a 15° bend with respect to the mixing lifter 32. The angled tip 36 helps the mixing lifter 30 retain particles longer and assists the mixing action of the clay slurry. In this embodiment, the drum 12 has six (6) mixing lifters 32, and each mixing lifter 32 has four (4) gussets 34 attached thereto.

The separation and discharge section 30 of the drum 12 has a greater diameter than the diameter of the mixing section 28. The greater diameter of the separation and discharge section 30 is needed to accommodate a discharge hopper 38, to be discussed in detail below, which is disposed in the separation and discharge section 30. A diameter extension flange 40 which connects the mixing section 28 to the separation and discharge section 30 of the drum 12 provides the needed increase in diameter. The separation and discharge section 30 contains a number of adjustable lifters 42. In this embodiment, the refiner 10 has six (6) adjustable lifters 42.

Figure 6:
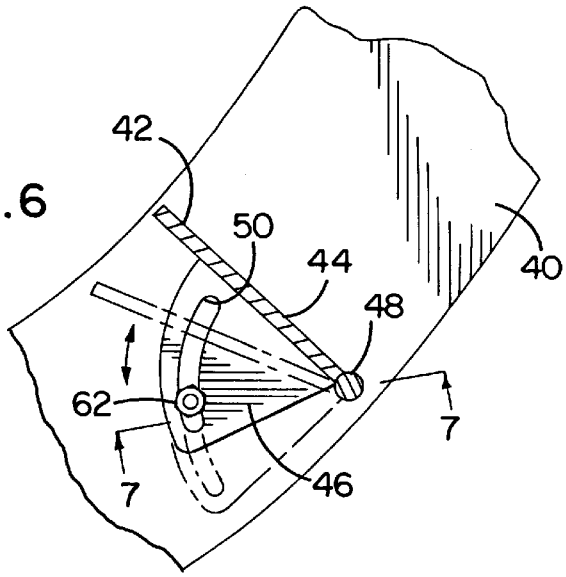
FIG. 6 is a detailed drawing illustrating the adjustability of an adjustable lifter of the present invention.
Figure 8:
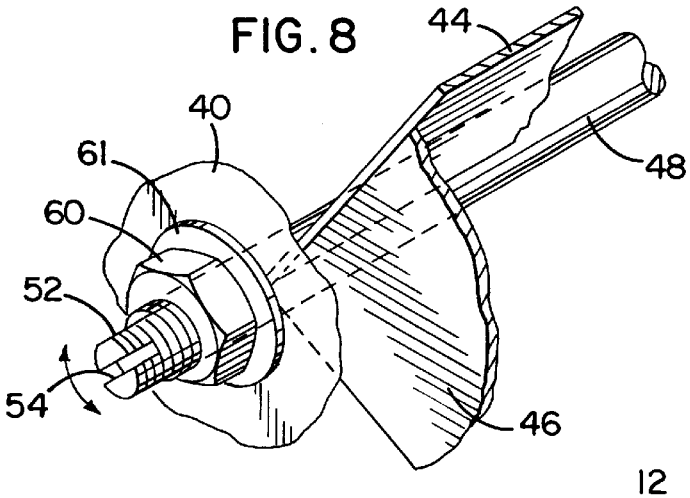
FIG. 8 is a partial view designated by the line 8—8 of one of the adjustable lifters of the present invention.
Figure 7:
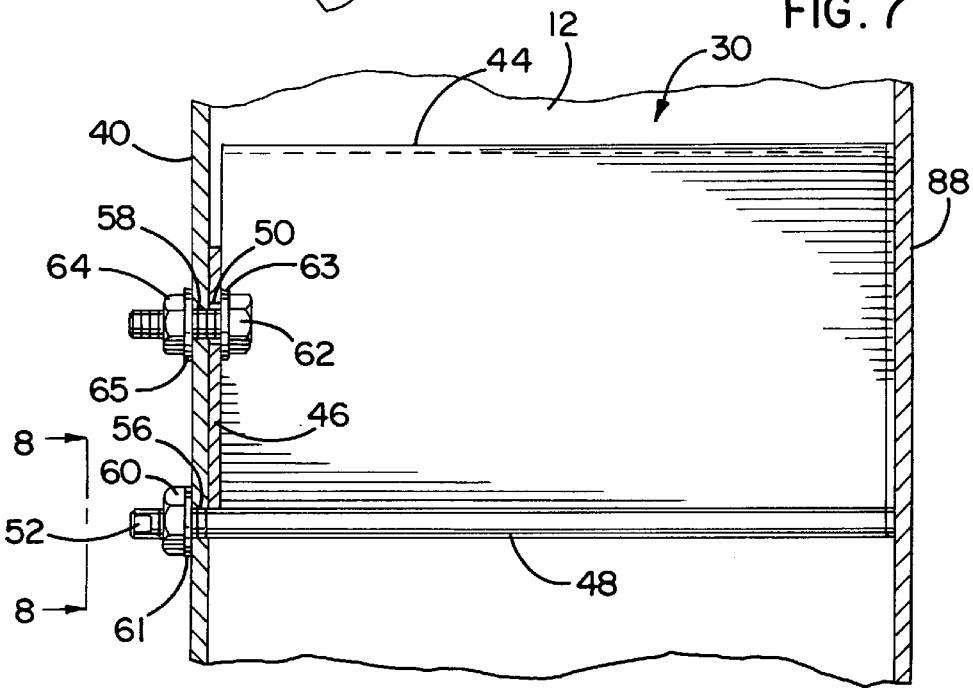
FIG. 7 is a sectional view taken along the line 7—7 in FIG. 6.

Referring to FIGS. 4–8, each adjustable lifter 42 includes a blade surface 44, an adjustable attachment flange 46 and a lifter shaft 48 which are all formed integral with one another. The lifter shaft 48 runs along the base of the blade surface 44, and the adjustable attachment flange 46 extends perpendicularly to the blade surface 44 and the lifter shaft 48. The adjustable attachment flange 46 includes a positioning slot 50 (FIG. 6) having a radius of curvature of four (4) inches in this embodiment. The lifter shaft 48, as shown in FIG. 8, has a threaded end 52, and this end defines an adjustment slot 54 having an orientation that is collinear with the orientation of the blade surface 44. The diameter extension flange 40 includes a series of lifter shaft openings 56 and a series of positioning bolt openings 58 (FIG. 7). The lifter shaft 48 of each adjustable lifter 42 is disposed in and passes through a corresponding lifter shaft opening 56 in the diameter extension flange 40 such that the threaded end 52 of the lifter shaft 48 extends outward from the opening 56. A fastener, such as nut 60, engages the threaded end 52 of the lifter shaft 48 and secures the adjustable lifter 42 to the diameter extension flange 40. A washer 61 may be used between the nut 60 and the exterior of the flange 40. A positioning bolt 62 extends through the positioning slot 50 of each adjustable attachment flange 46 and through each corresponding positioning bolt opening 58. A fastener, such as nut 64, disposed on the exterior of the diameter extension flange 40, engages the threaded portion of the bolt 62 and fixes the angular position of the adjustable lifter 42. A washer 63 may be used between the bolt 62 and the adjustable attachment flange 46, and another washer 65 may be used between the nut 64 and the exterior of the flange 40. It is foreseen that the drum 12 may be built to have a uniform diameter throughout the drum 12 that is large enough to accommodate the discharge hopper 38, such that the diameters of the mixing section 28 and the separation and discharge section 30 are equal. Consequently, it also foreseen that the mixing lifters 32 and the adjustable lifters 42 may be integral with one another, and not separate, such that the entire mixing lifter 32 would be adjustable.

To adjust the blade surface angle of a lifter 42, a user first loosens the nuts 60, 64, allowing the lifter 42 to rotate freely about shaft 48. The user then inserts a screwdriver (not depicted) or other flat-edged object into the adjustment slot 54 and turns the lifter shaft 48 of the lifter 42 to change the angle of the blade surface 44 (FIG. 6). The user can determine the angle of the lifter blade surface 44 with respect to interior of the drum 12 since the adjustment slot 54 is collinear with the blade surface 44. Once the user has set the lifter blade surface 44 at the desired angle, the user re-tightens the nut 64 to fasten the positioning bolt 62 and secure the adjustable attachment flange 46. The user then re-tightens the nut 60 to fasten the lifter shaft 48 and firmly secure the lifter 42 in place.

Referring back to FIG. 2, the circumference of the drum 12, exterior to the mixing section 28, includes a first support tire saddle 66, a driven sprocket 68 integral with a sprocket saddle 70, a thrust ring 72 integral with a thrust ring saddle 74 and a second support tire saddle 76. The driven sprocket 68 in this embodiment is a one hundred (100) tooth #160 sprocket. Extending outward from the separation and discharge section 30 of the drum 12 and in communication with the interior thereof is a drain coupling 78 for draining the drum 12. The drum 12 further has an inlet end 80 and a discharge end 82. The inlet end 80 is disposed at the forward end of the mixing section 28, and the discharge end 82 is disposed at the rearward end of the separation and discharge section 30. An inlet end plate 84 seals off the inlet end 80 of the drum 12 and attaches to the drum 12 along an end plate flange 86. Similarly, the discharge end 82 of the drum 12 is sealed off by an discharge end plate 88 which attaches to the drum 12 along an end plate flange 90. The inlet end plate 84 defines an opening 92 and integral with and passing through the opening 92 is a liquid deflector cone 94 having a flange 96. The liquid deflector cone 94 forms a liquid tight seal with the inlet end plate 84. A seal retainer 100 is connected to the flange 96 and holds a seal 98 in place between the seal retainer 100 and the flange 96. The discharge end plate 88 has a slurry discharge spout 104 which extends from the discharge end plate 88 and defines an opening 102 through which the clay slurry is discharged.

The conveyor assembly 20 extends through the length of the drum 12. The conveyor assembly 20 includes a housing assembly 106 and a feed screw conveyor assembly 108. The housing assembly 106 includes the material feed inlet 22, a housing 110, a liquid inlet sleeve 112, the discharge hopper 38 and the discharge chute 24. The material feed inlet 22 is formed integral with the housing 110 and defines an opening 114 (FIG. 1) which is offset from the centerline of the feed screw conveyor 26. The opening 114 of the material feed inlet 22 is offset from the centerline of the feed screw conveyor 26 so that the space between the feed screw conveyor 26 and the housing 110 is only partially filled at any one time with clay material, on the order of 45–50% conveyor loading. If the inlet opening 114 were centered along the centerline of the feed screw conveyor 26, the feed material being fed into the refiner 10 would completely fill the space between the feed screw conveyor 26 and the housing 110 possibly causing the feed screw conveyor 26 to jam. As is apparent from this description, clay is the feed material that this rotary clay material refiner 10 is designed for; however, it is foreseen that this refiner 10 may be used for similar aggregate or rock separation operations on other lighter solid materials. The term clay as it is used here means any type of hydrated silicate. In the preferred embodiment, this refiner 10 is designed for use specifically on all smectite clays, such as sodium bentonite and/or calcium bentonite clay, Fuller's Earth, attapulgite clays, and the like. The hopper 18, if used, is connected to the material feed inlet 22 and feeds material into the drum 12 via the inlet opening 114. The housing 110 is a hollow elongated cylinder which encloses the feed screw conveyor 26 and extends through the drum 12 passing through the drum end plate openings 92, 102. The housing 110 is partially cutaway within the drum 12 to create an opening 116 through which feed material drops from the housing 110 into the interior of the drum 12. The distance D (FIG. 2) from the material feed inlet 22 to the housing opening 116 is kept to a minimum to prevent clay, a highly viscous material, from building up in the housing 110 and jamming the feed screw conveyor 26. The liquid inlet sleeve 112 surrounds the portion of the housing 110 that passes through the inlet opening 92 of the drum 12. The liquid inlet sleeve 112 includes an annular shell 118, a liquid inlet coupling 120 and a liquid discharge coupling 122. The annular shell 118 surrounds the housing 110 and forms a liquid tight seal therewith. The annular shell 118 and the housing 110 create an annular space 124 through which liquid can flow from the liquid inlet coupling 120, around the housing 110 and into the drum 12 via the liquid discharge coupling 122. The seal 98 of the liquid deflector cone 94 engages the outer surface of the annular shell 118 and creates a liquid tight seal between the drum 12 and the liquid inlet sleeve 112 to keep clay slurry from leaking out of the drum 12.

The discharge hopper 38 is formed integral with the housing 110 and extends upward therefrom defining an opening 126 into which separated solid non-clay material is dropped. The discharge hopper 38 is disposed within the drum 12 near the discharge end 82. Located outside the drum 12 at the discharge end 82 is the discharge chute 24. The discharge chute 24 is also integrally formed with the housing 110 and extends downward therefrom defining an opening 128. Solid non-clay material separated from the clay and dropped into the discharge hopper 38 exits the refiner 10 through the discharge chute opening 128.

The feed screw conveyor assembly 108 includes the feed screw conveyor 26, a conveyor drive motor 130, a conveyor drive belt 132 and a conveyor drive reducer 134. The feed screw conveyor 26 traverses the length of the interior of the housing 110 and has two ends: a drive end 136 disposed near the inlet end 80 of the drum 12 and a support end 138 disposed near the discharge end 82 of the drum 12. The drive end 136 is in driving engagement with the drive reducer 134 and is supported by a bearing 140. An end plate 142 having an opening (not shown) is attached to the housing 110 and separates the bearing 140 from the interior of the housing 110. The support end 138 of the feed screw conveyor 26 passes through an opening 144 formed in an end plate 156 attached to the housing 110 and is supported by a bearing 146. The feed screw conveyor 26 of this embodiment is stainless steel having a pitch outer diameter of nine (9) inches. The flighting of the feed screw conveyor 26 is 3/16 of an inch thick and is mounted on a 2½ inch schedule 40 pipe. A feed screw conveyor is used in this embodiment; however, it foreseen that any type of conveying system that could move clay through the housing 110 and into the drum 12 is foreseen (e.g., a pulsating, axially-oriented piston disposed in the feed section of the housing 110).

The conveyor drive reducer 134 has a motor mount 148 extending downward therefrom to which the conveyor drive motor 130 is connected. The conveyor drive belt 132 encircles a sheave 150 (FIG. 1) of the conveyor drive motor 130 and a sheave 152 (FIG. 1) of the conveyor drive reducer 134 putting the conveyor drive motor 130 and the conveyor drive reducer 134 in transmissible relationship with one another. In this embodiment, the rotary clay material refiner 10 uses a 3 horsepower (hp), 1775 revolutions per minute (RPM) conveyor drive motor 130; the sheave ratio between sheaves 150, 152 is 3.75 to 1; and the maximum angular speed of the feed screw conveyor 26 is 19 RPM.

A pair of support braces 154 span between the housing 110 and the drum support assembly 16 to support the conveyor assembly 20 and to keep it centered within the drum 12. One support brace 154 connects to the housing 110 near the inlet end 80 of the drum 12 and the other to the housing 110 near the discharge end 82 of the drum 12.

Referring to FIG. 1, the drum rotation assembly 14 includes a drive chain 160, a drum drive motor 162, a drive motor gearbox 164 and a drive sprocket 166. The drum drive motor 162 is connected to the drive motor gearbox 164, and the drive motor gearbox 164 is connected to the drive sprocket 166. The drive chain 160 encircles the drive sprocket 166 and the driven sprocket 68 of the drum 12 putting the drum drive motor 162 in transmissible relationship with the drum 12. The drive motor gearbox 164, which supports the drum drive motor 162 and the drive sprocket 166, is mounted to the drum support assembly 16. In the preferred embodiment, the drum drive motor 162 is a 5 hp, 1750 RPM motor, and the ratio of the drive motor gearbox 164 is 25.6 to 1 with the maximum output RPM of the gearbox being 68.35 RPM. The drive sprocket 166 is an eleven (11) tooth #160 sprocket, and the drive chain 160 is #160 chain. The maximum angular speed of the drum 12 is 7½ RPM. The normal operating angular speed range of the drum 12 is one (1) RPM to six (6) RPM.

Referring to FIGS. 1 and 2, the drum support assembly 16 includes a bottom platform 170, a top platform 172, a base adjustment assembly 174, two pairs of drum trunnion assemblies 176, 177 and a pair of drum thrust roller assemblies 178. The bottom platform 170 includes a pair of side support beams 180 and a pair of cross support beams 182 (FIG. 1). Similarly, the top platform 172 also includes a pair of side support beams 184 and a pair cross support beams 186 (FIG. 1). The drive motor gearbox 164 is mounted to one of the top platform side support beams 184 by a mounting plate 168 (FIG. 1). The base adjustment assembly 174 includes two pairs of adjustment bolts 188 and a pair of hinges 190. The adjustment bolts 188 are disposed in and extend through openings 192 made in the top and bottom platform side support beams 180, 184. Both pairs of bolts 188 are disposed at the end of the drum support assembly 16 located below the inlet end 80 of the drum 12. One of the pair of bolts 188 is located on the same side of the drum support assembly 16 as the drum drive motor 162 (i.e. the near side) (FIG. 1), and the other pair of bolts 188 is located on the far side of the drum support assembly 16 (FIG. 2—only one bolt 188 of this pair is depicted). A series of nuts 194 disposed along the length of each bolt 188 allows the user to set the height of the top platform 172 with respect to the bottom platform 170. The pair of hinges 190 are disposed at the end of the drum support assembly 16 located below the discharge end 82 of the drum 12. The hinges 190 are connected to the top platform 172 and the bottom platform 170. One hinge 190 is located on the near side (FIG. 1), and the other hinge 190 located on the far side (FIG. 2). To adjust the height of the inlet end 80 of the drum 12, the user adjusts the nuts 194 upward or downward causing the top platform 172 and the inlet end 80 of the drum 12 to move upward or downward, respectively (FIG. 2).

Spanning the gap between the top platform side support beams 184 are two pairs of trunnion support beams 196 and a thrust roller support beam 198. Each pair of trunnion support beams 196 supports one of the pairs of drum trunnion assemblies 176, 177. One of the drum trunnion assemblies of each pair 176, 177 is disposed on the near side of the drum support assembly 16 (FIG. 1), and the other is disposed of the far side of the drum support assembly 16 (FIG. 2). Each drum trunnion assembly 176, 177 includes a pair of bearings 200, a pin 202 and a support tire 204. Each bearing 200 is attached to and supported by one of the trunnion support beams 196. The pin 202 is disposed in and extends between the bearing pair 200. The pin 202 also extends through the support tire 204 which is situated between the bearing pair 200. The first pair of drum trunnion assemblies 176 disposed near the inlet end 80 of the drum 12 contains the first support tires 204A which ride along the first support tire saddle 66 of the drum 12 (FIG. 2), and the second pair of drum trunnion assemblies 177 disposed near the discharge end 82 of the drum 12 contain the second support tires 204B which ride along the second support tire saddle 76 (FIG. 2). The support tires 204A, 204B used in the preferred embodiment are six (6) inches in diameter and six and a half (6½) inches wide.

The thrust roller support beam 198 and one of the trunnion support beams 196 support the pair of drum thrust roller assemblies 178 via a pair of mounting plates 206 (FIG. 2). Each drum thrust roller assembly 178 is vertically oriented and is disposed in the gap between the top platform side support beams 184. Each drum thrust roller assembly 178 includes two pairs of bearings 208, a pin 210 and a thrust tire 212. The pair of bearings 208 of each drum thrust roller assembly 178 are attached to a respective mounting plate 206 with the pin 210 disposed within the pair of bearings 208 and extending upward therefrom. The thrust tire 212 of each drum thrust roller assembly 178 is mounted on the pin 210 above the pair of bearings 208. Disposed between and in contact with the thrust tire 212 of each drum thrust roller assembly 178 is the drum thrust ring 72. The engagement of the drum thrust ring 72 and the drum thrust roller assemblies 178 keeps the drum 12 from shifting laterally during operation. In the preferred embodiment, the thrust tires 212 of the drum thrust roller assemblies 178 are five (5) inches in diameter and two and a half (2½) inches wide.

Referring to FIG. 3, the rotary clay material refiner 10 is operated by activating the conveyor drive motor 130 to rotate the feed screw conveyor 26 and by activating the drum drive motor 162 to rotate the drum 12 (FIG. 1). Clay material, in the preferred embodiment calcium bentonite, is fed through the hopper 18 to the material feed inlet 22 and into the housing 110. The feed screw conveyor 26 engages the clay material and conveys it forward through the housing 110 into the drum 12 via the opening 116 formed in the housing 110. At the same time, liquid, in the preferred embodiment water, is being fed into the drum 12 via the liquid inlet sleeve 112 causing the water and clay material to mix within the drum to form a clay slurry. It is important to note that due to the material qualities of clay that the water and the clay material must be kept separate until they are introduced into the drum 12. If the clay material and water were mixed together before being fed into the feed screw conveyor 26, the clay/water mixture would bind the feed screw conveyor 26 and possibly jam it.

Once the clay slurry is formed in the drum 12, the mixing lifters 32, which are rotating with the drum 12, agitate and mix the clay slurry in order to help dissolve the clay material. As the slurry continues to make its way through the drum 12, the mixing lifters 32 continue to mix the slurry. Once the slurry enters the separation and discharge section 30 of the drum 12, the blade surface 44 of the adjustable lifters 42 engages any aggregates or rocks that have not dissolved in the slurry. The adjustable lifters 42, due to centrifugal force, then drag these impurities with them along the circumference of the drum 12 and discharge the separated impurities into the discharge hopper 38 near the apex of the adjustable lifters 42 circular path of travel (FIG. 4). The separated impurities then travel down through the discharge hopper 38 and back into the housing 110. From the housing 110, the impurities are conveyed out of the drum 12 by the feed screw conveyor 26 and are discharged out of the housing 110 by a discharge chute 24 (FIG. 3). Once discharged, the rocks and other impurities are taken away by any feasible means (e.g., a conveyor belt). As the level of the slurry continues to rise in the separation and discharge section 30 of the drum 12, the slurry eventually gets as high as the slurry discharge spout 104. At that point, the slurry empties out the drum 12 through the opening 102 and is taken away from the drum 12 by any feasible means. This slurry formation and impurity separation continues continuously until the rotary clay material refiner 10 is turned off.

In the preferred embodiment, the slurry being produced has a ratio of 10–14% clay solids. To achieve this, calcium bentonite is usually fed into the refiner 10 at a rate of 6500 lbs/hr and water is fed into the refiner 10 at a rate of 89 gallons/min with the created slurry having between three (3) to ten (10) minutes dwell time in the drum 12. However, if the slurry coming out the refiner 10 does not have the proper solids ratios or too many impurities, the refiner 10 may be adjusted in a number of ways to alleviate these problems. To modify the exit slurry, the feed rate of water can be adjusted. The feed rate of clay can be adjusted as well by adjusting the angular speed of the feed screw conveyor 26. The angular speed of the drum 12 may be adjusted by changing the speed on the variable speed drum drive motor 162. Also, the amount of slurry kept in the drum 12 and slurry dwell time may also be affected by adjusting the height of the inlet end 80 of the drum 12. The inlet end 80 of the drum 12 may be adjusted by adjusting the bolts 188 in the drum support assembly 16 either upward or downward. If the refiner is not removing enough impurities or is removing wanted clay, the adjustable lifters 42 can be adjusted, as described above, to remove different size particles. During regular operation, the lifters 42 are set at an angle to remove impurities having a diameter between close to zero (0) to one (1) inch which is usually ideal for removing rocks.

The foregoing detailed description has been given for clearness of understanding only, and no unnecessary limitations should be understood therefrom, as modifications would be obvious to those skilled in the art.

We claim:

1. An apparatus for refining clay material comprising:

a drum having an inlet end and a discharge end opposite the inlet end;

means for supporting the drum;

means for conveying the clay material into the inlet end of the drum;

means, separate from the conveying means, for introducing liquid into the drum to form a clay slurry from the clay material and liquid mixed together within the drum;

means for rotating the drum;

a plurality of lifters disposed within the drum for refining the clay slurry by separating solid non-clay material from the clay slurry;

means for receiving the solid non-clay material separated by the lifters; and an opening formed in the discharge end of the drum, wherein the refined clay slurry discharges from the drum through the opening when the level of the refined clay slurry in the drum reaches the level of the opening.

2. The clay material refining apparatus of claim 1 wherein the lifters and the solid non-clay material receiving means are disposed adjacent to the discharge end of the drum.

3. The clay material refining apparatus of claim 1 wherein the lifters are angularly adjustable with respect to an inner surface of the drum.

4. The clay material refining apparatus of claim 1 wherein the means for supporting the drum is a base which may be adjusted vertically to alter the height of the drum inlet end.

5. The clay material refining apparatus of claim 1 further comprising means for removing the separated solid non-clay material from the solid non-clay material receiving means.

6. The clay material refining apparatus of claim 5 wherein a unitary conveyor comprises the conveying means and the removing means.

7. The clay material refining apparatus of claim 6 wherein the unitary conveyor is a feed screw conveyor.

8. The clay material refining apparatus of claim 7 wherein the feed screw conveyor has a centerline; and a material feed inlet is offset with respect to the centerline of and in communication with the feed screw conveyor.

9. An apparatus for refining clay material comprising:

a drum having an inlet end and a discharge end opposite the inlet end;

a base for supporting the drum which may be vertically adjusted to change the height of the drum inlet end;

a first variable speed conveyor for conveying the clay material into the inlet end of the drum;

a liquid inlet for introducing liquid into the drum and for controlling the rate of liquid introduction into the drum to form a clay slurry from the clay material and liquid mixed together within the drum;

a variable speed motor for rotating the drum;

a plurality of lifters disposed within the drum which are angularly adjustable with respect to an inner surface of the drum for refining the clay slurry by separating and lifting solid non-clay material from the clay slurry;

a discharge hopper for receiving the solid non-clay material separated by the adjustable lifters; and an opening formed in the discharge end of the drum, wherein the refined clay slurry discharges from the drum through the opening when the level of the refined clay slurry in the drum reaches the level of the opening;

whereby the adjustable base, the first variable speed conveyor, the rate of liquid introduced by the liquid inlet, the variable speed motor and the adjustable lifters are adjusted with respect to one another to create a refined clay slurry having approximately 10 to 14 percent clay solids.

10. The clay material refining apparatus of claim 9, wherein the lifters and the discharge hopper are disposed adjacent to the discharge end of the drum.

11. The clay material refining apparatus of claim 9 further comprising a second conveyor for removing the separated solid non-clay material from the discharge hopper.

12. The clay material refining apparatus of claim 11 wherein a unitary conveyor comprises the first variable speed conveyor and the second conveyor.

13. The clay material refining apparatus of claim 12 wherein the unitary conveyor is a feed screw conveyor.

14. The clay material refining apparatus of claim 13 wherein the feed screw conveyor has a centerline; and a material feed inlet is offset with respect to the centerline of and in communication with the feed screw conveyor.

15. A method for refining clay material comprising:

providing an apparatus having a drum with an inlet end and discharge end opposite the inlet end, a base for supporting the drum which may be vertically adjusted to change the height of the drum inlet end, a first variable speed conveyor, a liquid inlet, a variable speed motor for rotating the drum, a plurality of lifters disposed within the drum which are angularly adjustable with respect to an inner surface of the drum, a discharge hopper and a discharge opening formed in the drum;

adjusting the lifters to a desired angle with respect to the inner surface of the drum;

feeding clay material into the first conveyor;

metering a desired amount of clay material into the drum;

introducing liquid into the drum through the liquid inlet;

controlling the rate of liquid introduced into the drum;

rotating the drum to mix the clay material with the liquid to form a clay slurry and to position solid non-clay material on the lifters;

dropping the separated solid non-clay material from the lifters into the discharge hopper for removal;

allowing the refined clay slurry to rise to the level of the opening in the discharge end of the drum;

allowing the refined clay slurry to discharge through the discharge opening; and adjusting at least one of the adjustable base, the speed of the first conveyor, the rate of introduction of liquid, the speed of the rotating drum and the angle of the adjustable lifters to create a refined clay slurry having between approximately 10 to 14 percent clay solids.

16. The method for refining clay material of claim 15 further comprising:

providing the apparatus with a material feed inlet and offsetting the material feed inlet from a centerline of the first conveyor; and feeding clay material into the first conveyor through the material feed inlet such that the feed of the first conveyor is 45% to 50% at any given time.

17. The method for refining clay material of claim 15 further comprising:

providing the apparatus with a second conveyor which is unitary with the first conveyor; and conveying the separated solid non-clay material away from the discharge hopper via the unitary conveyor.

18. The method for refining clay material of claim 17 further comprising:

providing the apparatus with a discharge chute; and discharging the separated solid non-clay material which was conveyed from the discharge hopper out of the apparatus.

* * * * *